US009227145B2

(12) United States Patent
Chang et al.

(10) Patent No.: US 9,227,145 B2
(45) Date of Patent: Jan. 5, 2016

(54) PLANAR-PART-BASED TOY ASSEMBLY SET

(71) Applicants: Chun-Yeh Chang, Taipei (TW); Chia-Wen Hung, Taipei (TW)

(72) Inventors: Chun-Yeh Chang, Taipei (TW); Chia-Wen Hung, Taipei (TW)

( * ) Notice: Subject to any disclaimer, the term of this patent is extended or adjusted under 35 U.S.C. 154(b) by 104 days.

(21) Appl. No.: 14/149,145

(22) Filed: Jan. 7, 2014

(65) Prior Publication Data

US 2015/0190722 A1 Jul. 9, 2015

(51) Int. Cl.

| | |
|---|---|
| ***A63H 3/16*** | (2006.01) |
| ***A63H 3/10*** | (2006.01) |
| *A63H 33/06* | (2006.01) |

(52) U.S. Cl.

CPC .. *A63H 3/16* (2013.01); *A63H 3/10* (2013.01); *A63H 33/065* (2013.01)

(58) Field of Classification Search

CPC ..... Y10T 29/49826; B21D 28/06; A63F 9/10; A63F 2009/1016; A63F 2009/1072; A63F 9/12; A63F 2009/1248; A63H 33/04; A63H 33/06; A63H 33/16; A63H 33/042; A63H 33/044; A63H 33/048; A63H 33/065; A63H 3/08; A63H 3/14; A63H 3/16; A63H 3/46; A63H 3/52; A63H 3/365; A63H 9/00; A63H 9/008

See application file for complete search history.

(56) References Cited

U.S. PATENT DOCUMENTS

| | | | | | |
|---|---|---|---|---|---|
| 156,325 | A | * | 2/1875 | Hubbell | 446/383 |
| 575,749 | A | * | 1/1897 | Wilmer | 446/87 |
| 1,182,055 | A | * | 5/1916 | Thom | 446/100 |
| 1,211,590 | A | * | 1/1917 | Kennedy | 446/99 |
| 1,677,652 | A | * | 7/1928 | Peck | 446/376 |
| 1,702,539 | A | * | 2/1929 | Gove | 446/376 |
| 1,758,887 | A | * | 5/1930 | Gilbert | 446/113 |
| 1,777,948 | A | * | 10/1930 | Van Eerde | 446/99 |
| 2,025,295 | A | * | 12/1935 | McCully | 446/100 |
| 2,035,353 | A | * | 3/1936 | Torme | 446/316 |
| 2,137,575 | A | * | 11/1938 | Lincoln | 446/380 |
| 2,286,969 | A | * | 6/1942 | Lane | 446/383 |
| 2,334,486 | A | * | 11/1943 | Froehlig | 446/363 |
| 2,338,738 | A | * | 1/1944 | Rebholz | 446/100 |
| 2,365,098 | A | * | 12/1944 | Nudelman | 446/376 |
| 2,457,249 | A | * | 12/1948 | Lipschitz | 446/97 |
| 2,704,910 | A | * | 3/1955 | Paige | 446/388 |
| 2,731,766 | A | * | 1/1956 | Rubin | 446/99 |
| 2,836,926 | A | * | 6/1958 | Tseng | 446/15 |
| 2,902,821 | A | * | 9/1959 | Kelly, Jr. | 59/80 |
| 3,583,091 | A | * | 6/1971 | Brockway | 446/121 |
| 3,994,102 | A | * | 11/1976 | Johnson et al. | 52/2.21 |
| 4,118,887 | A | * | 10/1978 | Appleman | 446/97 |
| 4,170,083 | A | * | 10/1979 | Freelander et al. | 446/95 |
| 4,228,615 | A | * | 10/1980 | Melotti | 446/99 |
| 4,570,936 | A | * | 2/1986 | Meiser et al. | 273/157 R |

(Continued)

*Primary Examiner* — Michael Dennis
*Assistant Examiner* — Urszula M Cegielnik
(74) *Attorney, Agent, or Firm* — Rosenberg, Klein & Lee

(57) ABSTRACT

A planar-part-based toy assembly set includes planar parts that have different shapes and are made by stamping a planar material board. The planar parts include a body piece and a limb piece. The body piece has a slotted ring for coupling with the limb piece. The slotted ring has a cutting slot, a narrow section and, a wide section. The limb piece has a closed ring, or a slotted ring as stated above. The closed ring of the limb piece can pass through the cutting slot of the slotted ring of the body piece and be mounted around the narrow or wide section of the slotted ring. When the closed ring is around the narrow section, the limb piece can freely swing, and when the closed ring is around the wide section, the limb piece is fixed at a specific angle, which can be later adjusted by the player.

6 Claims, 7 Drawing Sheets

(56) References Cited

U.S. PATENT DOCUMENTS

| | | | | | |
|---|---|---|---|---|---|
| 4,798,317 | A * | 1/1989 | Lonczak | 223/66 |
| 5,465,961 | A * | 11/1995 | Burtch | 273/317.3 |
| 5,681,041 | A * | 10/1997 | Coon | 273/157 R |
| 5,704,177 | A * | 1/1998 | Wirkus et al. | 52/308 |
| 5,853,313 | A * | 12/1998 | Zheng | 446/106 |
| 6,120,344 | A * | 9/2000 | Brown | 446/388 |
| 6,234,858 | B1 * | 5/2001 | Nix | 446/97 |
| 6,238,259 | B1 * | 5/2001 | Medina | 446/71 |
| 6,475,060 | B1 * | 11/2002 | Liu | 446/487 |
| 6,478,653 | B1 * | 11/2002 | Langton | 446/373 |
| 6,575,803 | B1 * | 6/2003 | Liu | 446/147 |
| 6,626,732 | B1 * | 9/2003 | Chung | 446/387 |
| 6,672,931 | B1 * | 1/2004 | Bagley | 446/106 |
| 8,210,892 | B2 * | 7/2012 | Thrush et al. | 446/108 |
| 2004/0077268 | A1 * | 4/2004 | Wainohu | 446/222 |
| 2005/0113177 | A1 * | 5/2005 | Kuo | 472/1 |

* cited by examiner

PLANAR-PART-BASED TOY ASSEMBLY SET

BACKGROUND OF THE INVENTION

1. Technical Field

The present invention relates to toy model assembly kits, and more particularly to a planar-part-based toy assembly set composed of a plurality of planar parts that have different shapes and are made by stamping a planar material board using a stamping machine, wherein each of the planar parts can such couple with an adjacent planar part that the two coupled parts are allowed to swing with respect to each other or are fixed at a specific angle with respect to each other. In this manner, the planar parts can be assembled into a three-dimensional structure that can be posed to present different postures.

2. Description of Related Art

There are various toy model assembly kits available on the market, such as robot model assembly kits, animal model assembly kits and so on. For making these toys more interesting, the manufacturers usually provide parts of such a toy model assembly kit with joints that, when combined together, have their joining angle adjustable, thereby endowing the assembled models to change postures and thus be more realistic. However, since these existing posture-changeable model toys need structurally complicated parts, particularly the joint parts that allow their joining angle to be adjustable, the manufacturing costs are relatively high.

SUMMARY OF THE INVENTION

In view of this, the present invention provides an inexpensive, interesting and kaleidoscopic planar-part-based toy assembly set.

In other words, the primary objective of the present invention is to provide a planar-part-based toy assembly set composed of a plurality of planar parts that have different shapes and are made by stamping a planar material board using a stamping machine, wherein each of the planar parts can such engage with an adjacent planar part that the two engaged parts are allowed to swing with respect to each other or are fixed at a specific angle with respect to each other. In this manner, the planar parts can be assembled into a three-dimensional structure that can be posed to present different postures.

To achieve the foregoing objective, the present invention adopts the following technical means.

In the present invention, the planar-part-based toy assembly set comprises a plurality of planar parts that have different shapes and are made by stamping a planar material board using a stamping machine, and the planar parts includes at least one body piece and at least one limb piece.

The body piece is provided with at least one slotted ring that is configured to engage with the limb piece and connect the body piece and the limb piece together, wherein a cutting slot is provided at an outer side of the slotted ring, and the slotted ring has a circular enclosure including a narrow section and a wide section.

The limb piece is provided with at least one closed ring, or at least one slotted ring structurally similar to the slotted ring of the body piece.

The closed ring has an inner diameter greater than a width of the narrow section of the slotted ring and smaller than a width of the wide section of the slotted ring.

The closed ring of the limb piece can be mounted around the narrow section or the wide section of the slotted ring of the body piece through the cutting slot at the outer side of the slotted ring of the body piece, thereby connecting the limb piece and the body piece together.

The closed ring of the limb piece can be mounted around the narrow section or the wide section of another limb piece through the cutting slot at the outer side of the slotted ring of the second limb piece, thereby connecting the limb piece and the second limb piece together.

When the closed ring is mounted around the narrow section, the limb piece is allowed to swing. When the closed ring is mounted around the wide section, the limb piece is fixed at a specific angle, which can be later adjusted by the player as desired.

In manufacturing, the body piece may be provided with the closed rings, and the limb piece may be provided with both the slotted rings and the closed rings, so as to enhance the overall assembling variability of the toy.

When plural body pieces and plural limb pieces are assembled together, with the combination of the slotted rings and the closed rings as described previously, the joining angle between adjacent body piece and limb piece, or between the adjacent two limb pieces can be adjusted, allowing the assembled toy to be a posture-changeable three-dimensional structure, with each said limb piece angularly changeable, thereby significantly enhancing the assembling variability and fun.

The disclosed toy assembly set may selectively contain planar parts made by stamping a planar material board using a stamping machine so as to form different toy model assembly kits, such as a human toy model assembly kit, a robot model assembly kit, an animal toy model assembly kit, an insect toy model assembly kit and so on and have the assembled model to be changeable in posture by adjusting its limb pieces.

The disclosed planar-part-based toy assembly set has its planar parts made by stamping a planar material board using a stamping machine, so enjoys the advantages of having the material highly available, and having the manufacturing convenient, fast and inexpensive, thereby achieving the objective of the present invention.

The invention will be best understood by reference to the following detailed description when read in conjunction with the accompanying drawings.

DETAILED DESCRIPTION OF THE INVENTION

The description is first directed to the basic parts and structure of the disclosed planar-part-based toy assembly set.

Figure 1:
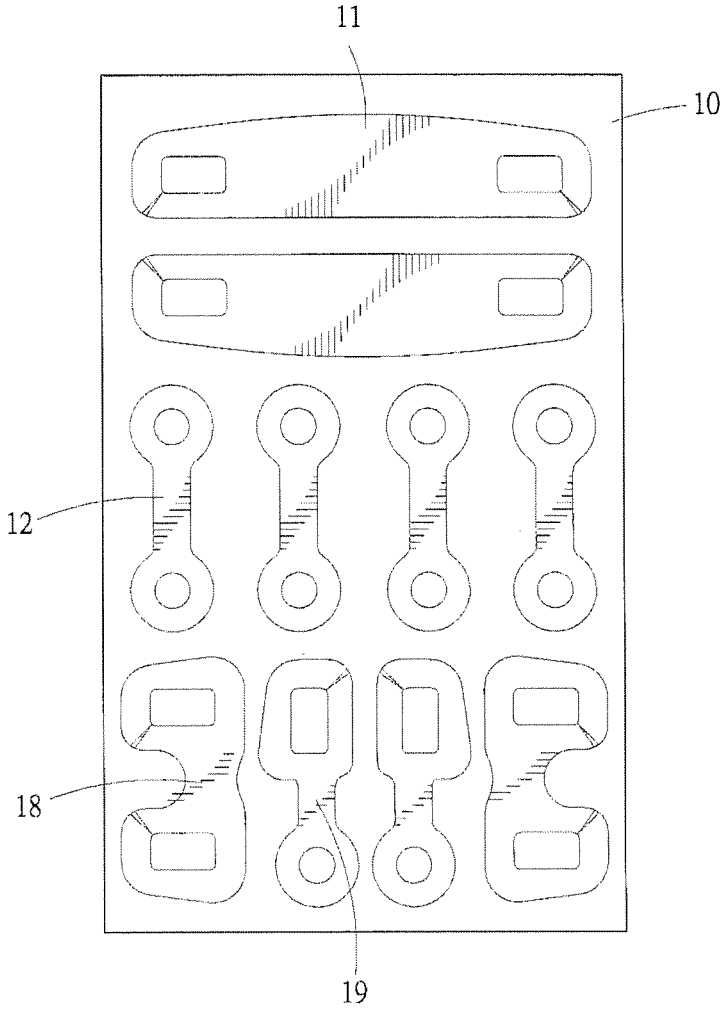
FIG. 1 is a plane view of a basic part template of a planar-part-based toy assembly set according to the present invention.

FIG. 1 is a plane view of a basic part template of a planar-part-based toy assembly set according to the present invention.

Figure 2:
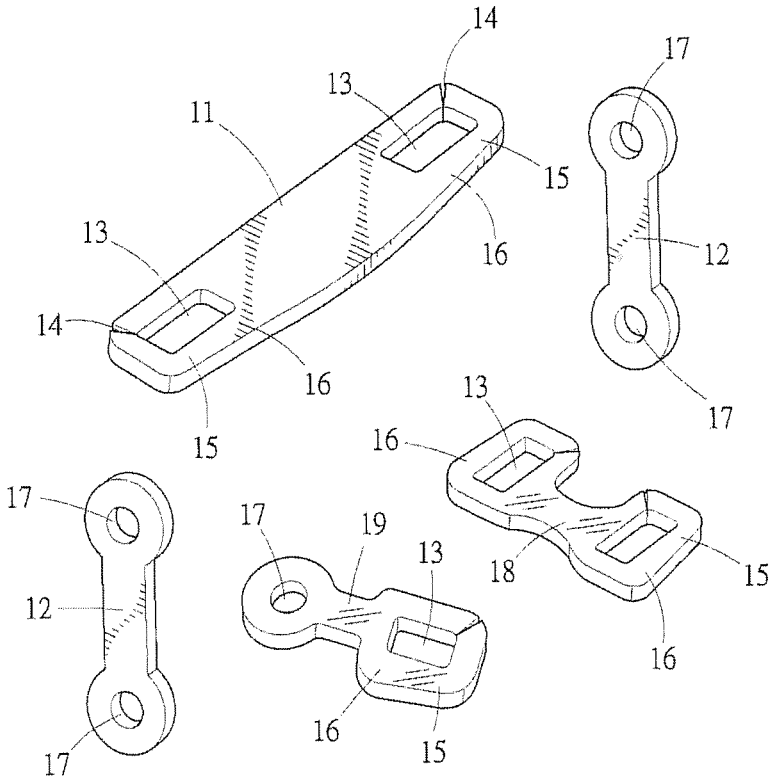
FIG. 2 is a perspective view of the basic parts of the planar-part-based toy assembly set of FIG. 1.

FIG. 2 is a perspective view of the basic parts of the planar-part-based toy assembly set of FIG. 1.

Figure 3:
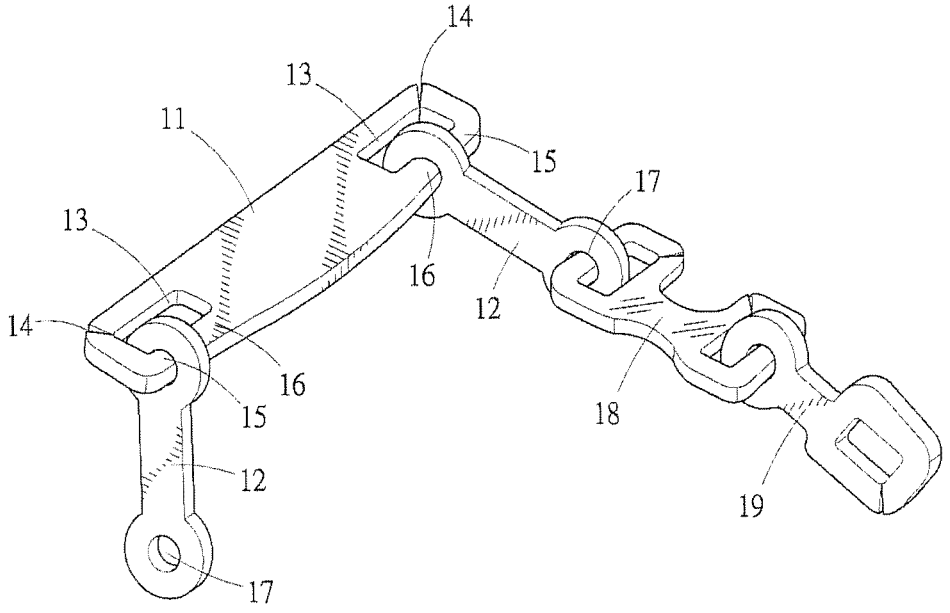
FIG. 3 is an assembled perspective view of the basic parts of the planar-part-based toy assembly set of FIG. 1.

FIG. 3 is an assembled perspective view of the basic parts of the planar-part-based toy assembly set of FIG. 1.

FIG. 3 is an assembled perspective view of the basic parts of the planar-part-based toy assembly set of FIG. 1.

As shown in FIG. 1, the disclosed planar-part-based toy assembly set is made by using a stamping machine to stamp a planar material board 10 to provide a plurality of planar parts of different shapes, including at least one body piece 11 and at least one limb piece 12, 18 or 19.

Referring to FIG. 2 and FIG. 3, the body piece 11 has at least one slotted ring 13, whose outer side is formed with a cutting slot 14, and whose circular enclosure is formed with a narrow section 15 and a wide section 16.

The limb piece 12 has at least one closed ring 17, or has at least one slotted ring 13 structurally similar to the forgoing slotted ring, such as the limb piece 18 and the limb piece 19 in FIG. 2.

The closed ring 17 has an inner diameter greater than a width of the narrow section 15 of the slotted ring 13, and smaller than a width of the wide section 16 of the slotted ring 13.

The closed ring 17 on the limb piece 12 or 19 can pass the cutting slot 14 at the outer side of the slotted ring 13 of the body piece 11, and be mounted around the narrow section 15 or the wide section 16 of the slotted ring 13, so as to combine the limb piece 12 or 19 and the body piece 11 together, as shown in FIG. 3.

The closed ring 17 on the limb piece 12 or 19 can alternatively pass the cutting slot 14 at the outer side of the slotted ring 13 of another limb piece 18 or 19, and be mounted around the narrow section 15 or the wide section 16 of the slotted ring 13, so as to combine the limb pieces 18 and 19 together, as shown in FIG. 3.

Referring to FIG. 3, when the closed ring 17 of the limb piece 12 or 19 is mounted around the narrow section 15 of the slotted ring 13 of its adjacent part, the limb piece 12 or 19 is allowed to freely swing. When he closed ring 17 of the limb piece 12 or 19 is mounted around the wide section 16 of the slotted ring 13 of its adjacent part, the limb piece 12 or 19 is fixed at a specific angle, which can be later adjusted by the player as desired.

In practical manufacturing, the body piece 11 may be provided with the closed ring 17 as well, while the limb piece 12 may be provided with both a slotted rings 13 and a closed rings 17 (such as the limb piece 19), thereby enhancing the overall assembling variability of the toy.

It is possible to use plural body pieces 11 and limb pieces 12, 18 and 19 to assemble a toy. With the combination of the slotted ring 13 and the closed ring 17 as stated above, the joining angles between the adjacent body piece 11 and the limb pieces 12 and 19, or between the adjacent limb pieces 12, 18 and 19 can be adjusted, making the assembled three-dimensional structure changeable in posture.

The following description is then directed to a preferred embodiment of the disclosed planar-part-based toy assembly set.

Figure 4:
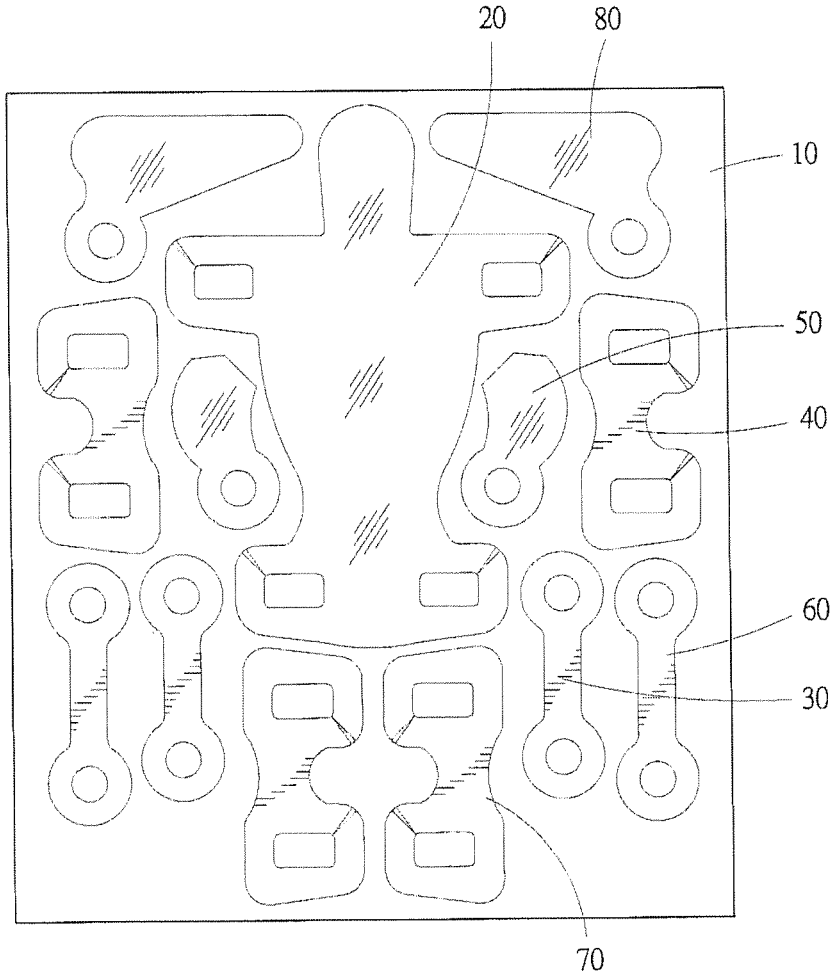
FIG. 4 is a plane view of a part template of a planar-part-based toy assembly set according to one embodiment of the present invention.

FIG. 4 is a plane view of a part template of a planar-part-based toy assembly set according to one embodiment of the present invention.

Figure 5:
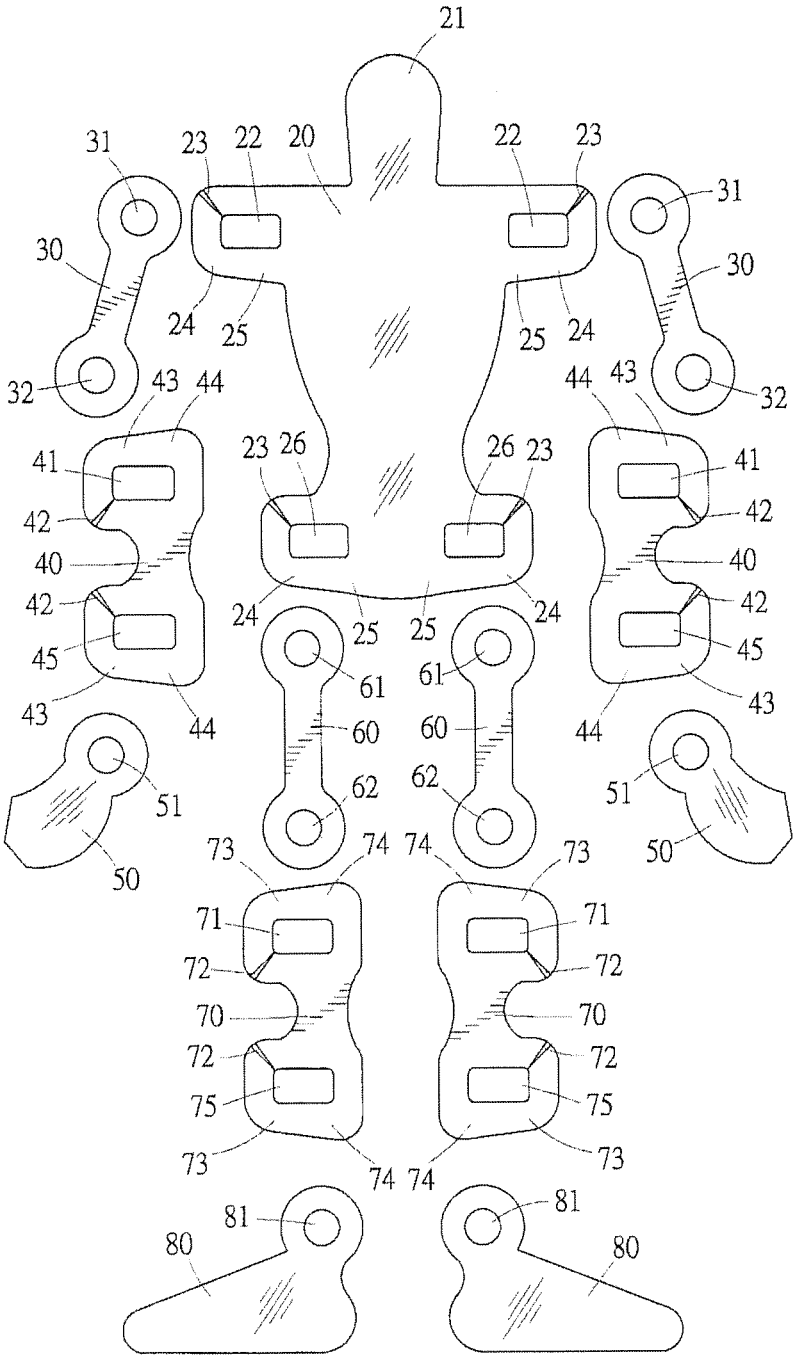
FIG. 5 is a plane view of the parts of the planar-part-based toy assembly set of FIG. 4.

FIG. 5 is a plane view of the parts of the planar-part-based toy assembly set of FIG. 4.

Figure 6:
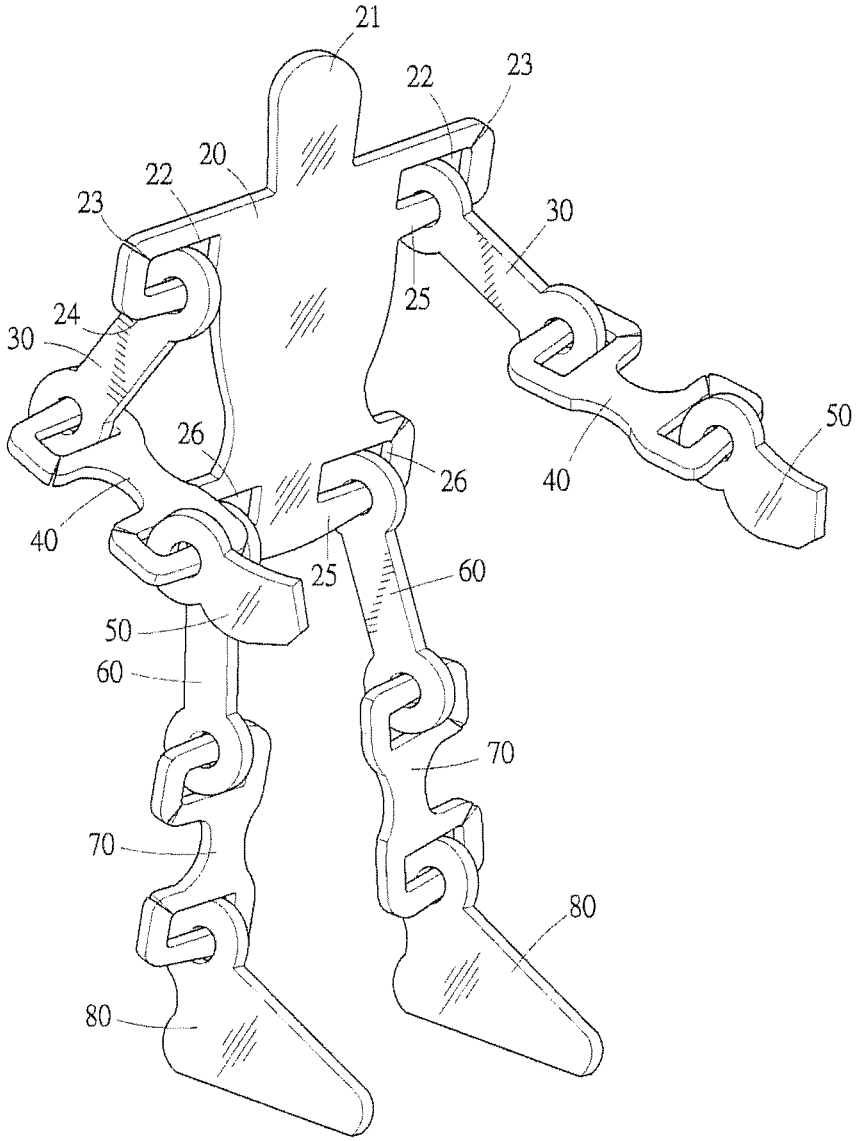
FIG. 6 is an assembled perspective view of the parts of the planar-part-based toy assembly set of FIG. 4.

FIG. 6 is an assembled perspective view of the parts of the planar-part-based toy assembly set of FIG. 4.

Referring to FIG. 4, the planar-part-based toy assembly set in the present embodiment is composed of body and limb pieces that have different shapes and are made by stamping a planar material board 10 using a stamping machine. The body piece includes a trunk 20, and the limb piece includes a pair of upper arm portions 30, a pair of lower arm portions 40, a pair of hand portions 50, a pair of thigh portions 60, a pair of shank portions 70, and a pair of foot portions 80.

As shown in FIG. 5, the trunk 20 is atop provided with a projecting head portion 21, and at it upper and lower parts each bilaterally provided with slotted rings 22 or 26. Each of the slotted rings 22 and 26 has its outer side formed with a cutting slot 23, and has its circular enclosure including a narrow section 24 and a wide section 25. The slotted rings 22 in the upper part of the trunk 20 each allow one said upper arm portion 30 to engage therewith, and the slotted rings 26 of the trunk 20 each allow one said thigh portion 60 to engage therewith.

Still referring to FIG. 5, the upper arm portion 30 has its two ends provided with closed rings 31 and 32, respectively. The upper closed ring 31 can pass through the cutting slot 23 of the upper slotted ring 22 of the trunk 20 and enter and couple with the upper slotted ring 22. The lower closed ring 32 of the upper arm portion 30 can enter and couple with the upper-end slotted ring 41 of the lower arm portion 40.

Seeing FIG. 5, the lower arm portion 40 has its two ends provided with slotted rings 41 and 45, respectively. Each of the slotted rings 41 and 45 has its outer side formed with the cutting slot 42, and has its circular enclosure including a narrow section 43 and a wide section 44. The upper slotted ring 41 of the lower arm portion 40 allows the lower closed ring 32 of the upper arm portion 30 to pass through the cutting slot 42 of the upper slotted ring 41 and enter and couple with the upper slotted ring 41. The lower slotted ring 45 of the lower arm portion 40 allows the closed ring 51 of the hand portion 50 to pass the cutting slot 42 of the lower slotted ring 45 and enter and couple with the lower slotted ring 45 of the lower arm portion 40.

Also shown in FIG. 5, the hand portion 50 has a closed ring 51, for coupling with the lower slotted ring 45 of the lower arm portion 40.

Again referring to FIG. 5, the thigh portion 60 has its two ends provided with closed rings 61 and 62, respectively. The upper closed ring 61 can pass through the cutting slot 23 of the lower slotted ring 26 of the trunk 20 and enter and couple with the lower slotted ring 26, and the lower closed ring 62 of the thigh portion 60 can enter and couple with the upper slotted ring 71 of the shank portion 70.

Staying with FIG. 5, the shank portion 70 has its two ends provided with slotted rings 71 and 75, respectively. Each of the slotted rings 71 and 75 has its outer side formed with a cutting slot 72, and has its circular enclosure including a narrow section 73 and a wide section 74. The upper slotted ring 71 of the shank portion 70 allows the lower closed ring 62 of the thigh portion 60 to pass through the cutting slot 72 of the upper slotted ring 71 and enter and couple with the upper slotted ring 71. The lower slotted ring 75 of the shank portion 70 allows the closed ring 81 of the foot portion 80 to pass through the cutting slot 72 of the lower slotted ring 75 of the shank portion 70 and enter and couple with the lower slotted ring 75.

Also in FIG. 5, the foot portion 80 has a closed ring 81, for coupling with the lower slotted ring 75 of the shank portion 70.

The slotted rings 22, 26 of the trunk 20 and the slotted rings 41, 45 of the lower arm portion 40 and the slotted rings 71, 75 of the shank portion 70 are all structurally identical, and each of them has its circular enclosure including the narrow section and the wide section as described above.

The closed rings 31, 32 of the upper arm portion 30, and the closed ring 51 of the hand portion 50, and the closed rings 61, 62 of the thigh portion 60, and the closed ring 81 of the foot portion 80 are all structurally identical, and each of them has an inner diameter, greater than the width of the narrow section of the slotted ring and smaller than the width of the wide section of the slotted ring.

By selectively coupling the slotted and closed rings of the adjacent planar parts, a human model can be formed, as shown in FIG. 6.

When the closed rings of the planar parts are all mounted around the narrow sections, the assembled human model can have its arms and legs freely swinging, like a hung skeleton.

When the closed rings of the planar parts are all mounted around the wide sections, the assembled planar parts are fixed and give the assembled human model a specific posture.

Then the player can adjust individual planar parts, to make the closed rings mounted around the wide sections in different angles, so that the assembled human model is presented as a posture-changeable three-dimensional structure that can stand, as shown in FIG. 6, or be posed otherwise.

In the embodiment of the planar-part-based toy assembly set depicted in FIG. 4 through FIG. 6, the trunk 20 may has its waist portion or a site between the head portion 21 and the trunk 20 provided with additional slotted rings and closed rings, thereby further enhancing the postural variability of the assembled toy human model.

Figure 7:
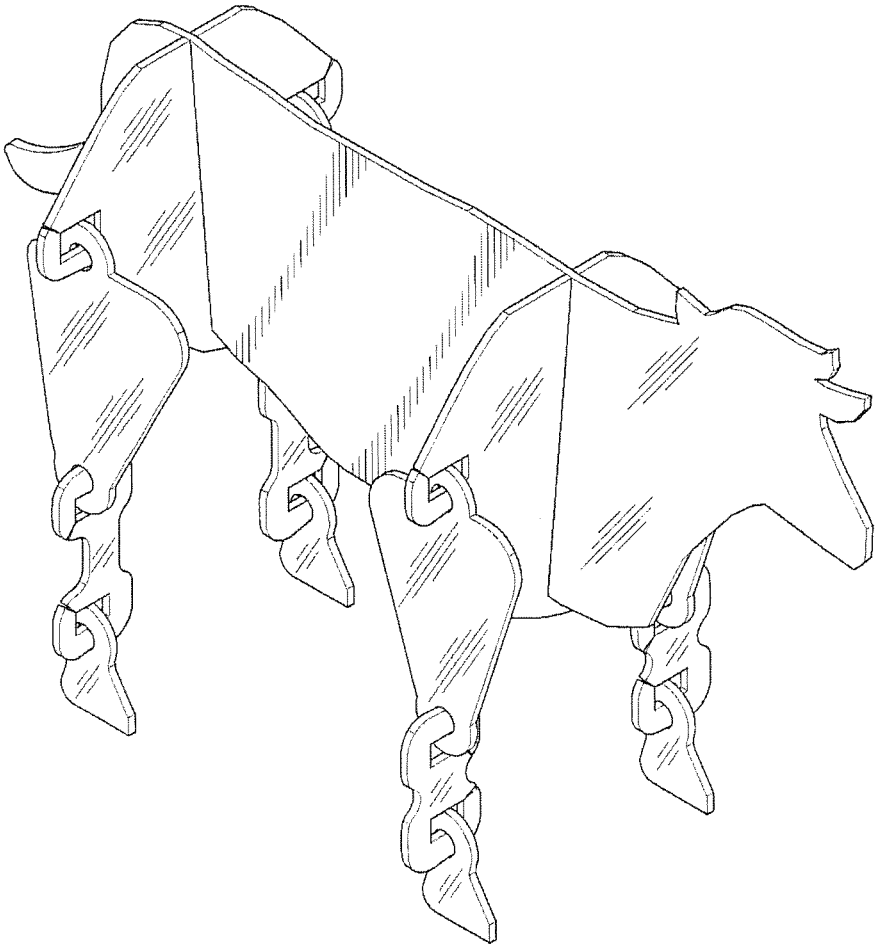
FIG. 7 is an assembled perspective view of a planar-part-based toy assembly set according to another embodiment of the present invention.

The embodiment of the planar-part-based toy assembly set depicted in FIG. 4 through FIG. 6 is intended to give an example of a toy model achievable to the present invention only, and is not for limiting the present invention to such a toy human model. In practical use, the planar material board 10 may be such stamped that it provides planar parts, which have different shapes but have structurally identical said slotted and closed rings, so as to be assembled into various toy models, such as the toy animal model as shown in FIG. 7, or a robot model assembly kit, or a toy insect model.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A planar-part-based toy assembly set, comprising:

a plurality of planar parts having different shapes and made by stamping a planar material board using a stamping machine, wherein the planar parts include:

at least one body piece, defining at least one slotted ring looped about a central opening, the loop being broken by a cutting slot extending from the central opening transversely out through a first segment of the slotted ring, the slotted ring including a second segment offset from the first segment, the second segment being tapered in width between a narrow section and a wide section; and at least one limb piece, defining at least one of a closed ring, or at least one said slotted ring, the closed ring forming an unbroken loop about an inner opening configured to loosely receive the narrow section of the slotted ring second segment passed therethrough and retentively engage the wide section of the slotted ring second segment passed therethrough, wherein the closed ring of said limb piece is configured to insert transversely through the cutting slot at the first segment of the slotted ring of the body piece or another limb piece, and be selectively positioned around the narrow section or the wide section of the slotted ring to couple the limb piece to the body piece or another limb piece, when the closed ring of the limb piece is positioned around the narrow section of the slotted ring, the limb piece is allowed to freely swing thereabout, and when the closed ring of the limb piece is positioned around the wide section of the slotted ring, the limb piece is fixed thereabout at a specific angle set in adjustable manner.

2. The planar-part-based toy assembly set of claim 1, wherein the body piece has one said closed ring.

3. The planar-part-based toy assembly set of claim 1, wherein the limb piece has both one said slotted ring and one said closed ring.

4. The planar-part-based toy assembly set of claim 1, wherein the body piece includes a trunk having a projecting head portion, a pair of the slotted rings bilaterally disposed at an upper part thereof, and a pair of the slotted rings bilaterally disposed at a lower part thereof, wherein each of the slotted rings in the upper part of the trunk is coupled to an upper arm portion of the limb piece, and each of the slotted rings in the lower part of the trunk is coupled to a thigh portion of the limb piece.

5. The planar-part-based toy assembly set of claim 4, wherein the body piece includes at least one of said slotted and closed rings formed at a waist portion of the trunk or between the head portion and an upper part of the trunk.

6. The planar-part-based toy assembly set of claim 4, comprising a plurality of the limb pieces, wherein the limb pieces include:

a pair of upper arm portions, each having upper and lower ends thereof provided with the closed rings, wherein the upper closed ring is configured to insert transversely through the cutting slot of one of the upper slotted rings of the trunk and couple therewith;

a pair of lower arm portions, each having upper and lower ends thereof provided with the slotted rings, wherein the upper slotted ring of the lower arm portion couples to the lower closed ring of the upper arm portion inserted transversely through the cutting slot thereof;

a pair of hand portions, each having a closed ring coupling with the lower slotted ring of one of the lower arm portions;

a pair of thigh portions, each having upper and lower ends thereof provided with the closed rings, wherein the upper closed ring is configured to insert transversely the cutting slot of the lower slotted ring of the trunk and couple therewith;

a pair of shank portions, each having upper and lower ends thereof provided with the slotted rings, wherein the upper slotted ring of the shank portion couples to the lower closed ring of the thigh portion inserted transversely through the cutting slot thereof; and a pair of foot portions, each having a closed ring coupling with the lower slotted ring of one of the shank portions.

* * * * *